US006641671B2

(12) United States Patent
Shinozaki et al.

(10) Patent No.: US 6,641,671 B2
(45) Date of Patent: Nov. 4, 2003

(54) COATING APPARATUS FOR APPLYING COATING MATERIAL INTERMITTENTLY TO SUBSTRATE

(75) Inventors: Kenya Shinozaki, Kumamoto (JP); Yoshiyuki Sakai, Numazu (JP)

(73) Assignee: Toshiba Kikai Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 09/920,840

(22) Filed: Aug. 3, 2001

(65) Prior Publication Data

US 2002/0017238 A1 Feb. 14, 2002

(30) Foreign Application Priority Data

Aug. 4, 2000 (JP) ..... 2000-237247

(51) Int. Cl.[7] ..... B05C 11/00
(52) U.S. Cl. ..... 118/684; 118/669
(58) Field of Search ..... 118/683, 684, 118/669, 410, 419, 679, 698, 697, 699, 704, 712, 325

(56) References Cited

U.S. PATENT DOCUMENTS 5,882,407 A * 3/1999 Takeno et al.
6,455,105 B1 * 9/2002 Sakai et al.

FOREIGN PATENT DOCUMENTS

JP 1176901 * 3/1999
JP 33315 * 2/2000

* cited by examiner

*Primary Examiner*—Brenda A. Lamb
(74) *Attorney, Agent, or Firm*—Pillsbury Winthrop LLP

(57) ABSTRACT

The coating material is supplied to a coating die provided with a manifold chamber, a draw-in chamber provided with a diaphragm, a supply passage and a discharge opening. The coating material is stored temporarily in the manifold chamber, is supplied through the supply passage to the discharge opening, and is discharged through the discharge opening onto the surface of the base sheet. The discharge of the coating material through the discharge opening is interrupted by deforming the diaphragm so as to form a draw-in chamber. The ball nut is driven by the servomotor so as to move the ball screw axially away from the supply passage to deform the flexible diaphragm so that the coating material is drawn into the draw-in chamber to interrupt discharging the coating material through the discharge opening. Thus, the coating material is applied intermittently to the substrate.

6 Claims, 3 Drawing Sheets

COATING APPARATUS FOR APPLYING COATING MATERIAL INTERMITTENTLY TO SUBSTRATE

BACKGROUND OF THE INVENTION

1. Field of the Invention

The present invention relates to an apparatus for applying a coating material intermittently to a surface of a substrate which is conveyed continuously.

2. Description of the Related Art

FIG. 4 shows a conventional intermittent coating apparatus. A coating die 1 is provided with a inlet port 3, a manifold chamber 4, a supply passage 5, and a discharge opening 7 defined by lips 6. A coating material 2 supplied through the inlet port 3 into the manifold chamber 4 in which the coating material 2 is stored temporarily The coating material 2 is supplied through the inlet passage 5 (as shown by arrows) and is extruded through the discharge opening 7 onto a surface of a substrate 8 being moved upward continuously at a uniform rate, as viewed in FIG. 4. A flexible sheet 9 similar to a diaphragm is placed in a draw-in chamber 14 formed in a part of the supply passage 5. The lower end of an operating rod 10 attached to the flexible sheet 9 is set upright and is biased upward by a spring 11. A cam follower 12 is supported for rotation in the upper end of the operating rod 10. An eccentric cam 13 which drives the operating rod 10 for reciprocating movement in the axial direction is in engagement with the cam follower 12. The eccentric cam 13 drives tho operating rod 10 up and down to bend the flexible plate 9 reciprocally. When the operating rod 10 is moved upward away from the supply passage 5, the flexible sheet 9 is force to bend in an upward convex shape with the volume of the draw-in chamber 14 increasing. Consequently, the amount of the-coating material 2 supplied while the flexible sheet 9 is bent in an upward convex shape is absorbed by the increase of the volume of the draw-in chamber 14 and the discharge of the coating material 2 onto the substrate 8 is suspended. Thus, the flexible sheet 9 is bent reciprocally in an upward convex shape to apply the coating material 2 intermittently to the substrate 8.

There are various patterns to intermittent coating on to the substrate 8 which has different pitch of the coating. The coating pattern is depend on the shape of the eccentric cam 13 which prescribes a cam diagram. It has a disadvantage that the eccentric cam 13 is unable to cope with the change of the coating material and the coating pattern. Therefore, a new eccentric cam must be newly designed and made when the coating material or the coating pattern is changed. However, the design of a suitable eccentric cam is difficult, and experiments must be conducted repeatedly by a trial-and-error method to design a suitable eccentric cam, which requires enormous time and expenses. The flexible sheet can be vertically deformed in a fixed range, and the circumference and the diameter of the eccentric cam must meet limiting conditions.

SUMMARY OF THE INVENTION

Accordingly, it is an object of the present invention to make making an eccentric cam every time the coating pattern or the coating material is changed unnecessary, to eliminate troublesome work requiring time and expenses for making an eccentric cam and to provide an intermittent coating apparatus capable of readily coping with the change of the coating material and coating conditions and of properly achieving a desired intermittent coating operation.

The present invention provides an coating apparatus for applying a coating material to a surface of a substrate being moved continuously, said apparatus comprises: a coating die provided with a inlet port through which the coating material is introduced into the coating die, a discharge opening confronting with the substrate, through which the coating material is discharged onto the surface of the substrate a supply passage defined in the coating die so as to communicate the inlet port with the discharge opening, a manifold chamber for temporarily storing the coating material supplied thereto and is formed in a part of the supply passage, and a flexible sheet adapted to be displaceable away from the supply passage so that a draw-in chamber for absorbing the coating material is formed in the supply passage, a ball screw mechanism having a ball screw adapted to move in the axial direction to cause the flexible sheet for displacement, a servomotor for driving the ball screw mechanism, and a intermittent motion generating means for applying an intermittent reciprocating motion to the ball screw so that the draw-in chamber repeats a expansion and a contraction periodically.

According to the present invention, it is unnecessary to prepare an eccentric cam every time the coating pattern or the coating material is changed, and troublesome work requiring time and expenses for conducting experiments and making eccentric cams by a trial-and-error method is eliminated. The present invention enables properly intermittently applying a coating material to a base sheet regardless of change in the coating pattern and/or the quality of the coating material.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
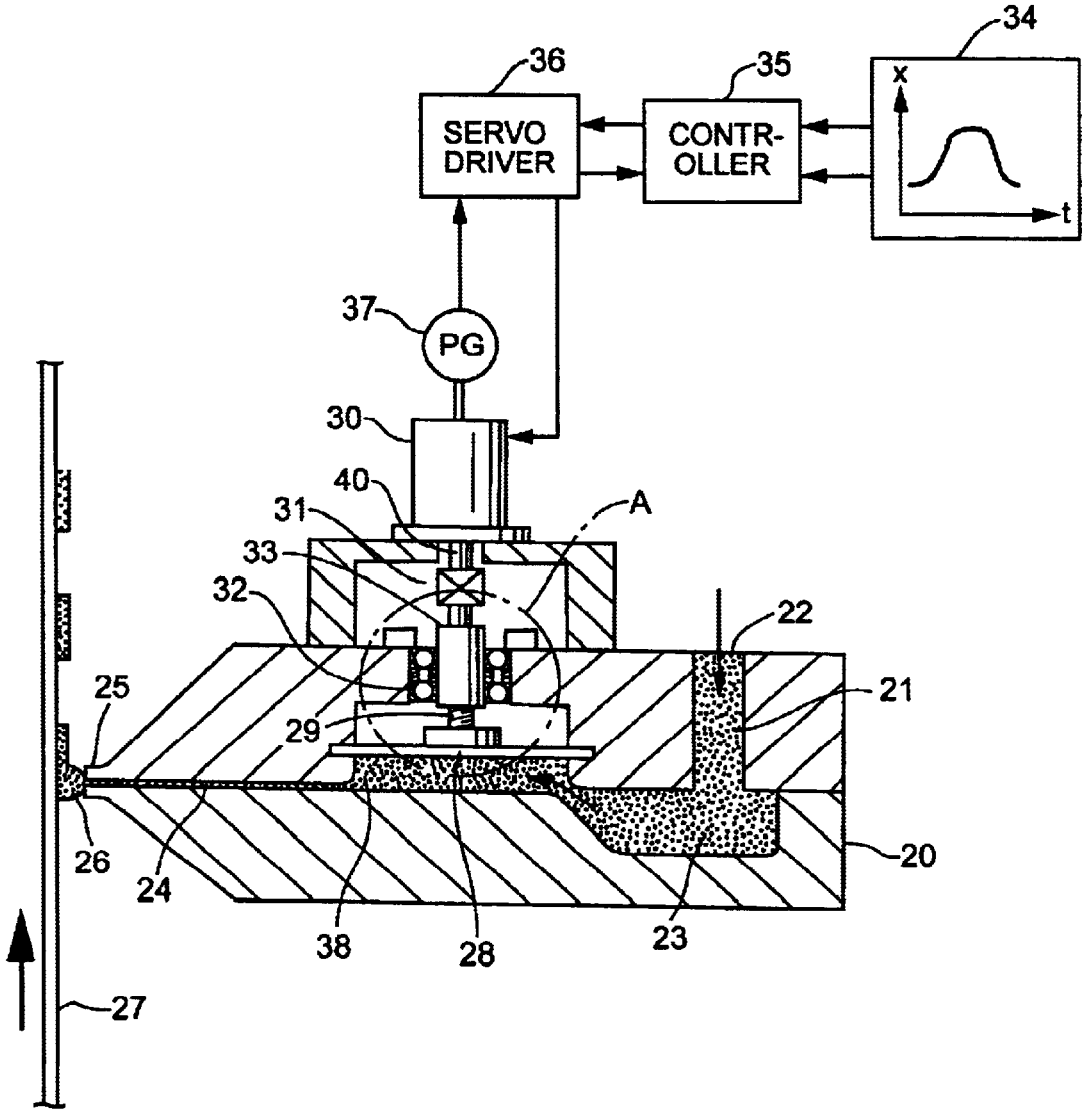
FIG. 1 is a schematic, patly sectional view of an intermittent coating apparatus in a preferred embodiment according to the present invention.

FIG. 1 shows a embodiment according to the present invention. A coating die 20 is provided with a inlet port 21, a manifold chamber 23, a supply passage 24, and a discharge opening 26 defined by lips 25. A coating material 21 is supplied through the inlet port 22 into the manifold chamber 23 in which the coating material 21 is stored temporarily. The coating material 21 is supplied through the inlet passage 24 (as shown by arrows) and is extruded through the discharge opening 26 onto a surface of a substrate 27 being moved upward continuously at a uniform rate, as viewed in FIG. 1.

Figure 2:
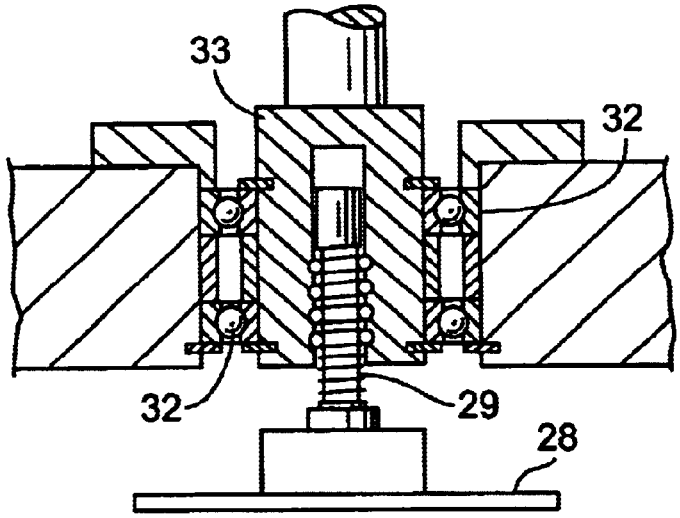
FIG. 2 is an enlarged view of a part A in FIG. 1.
Figure 4:
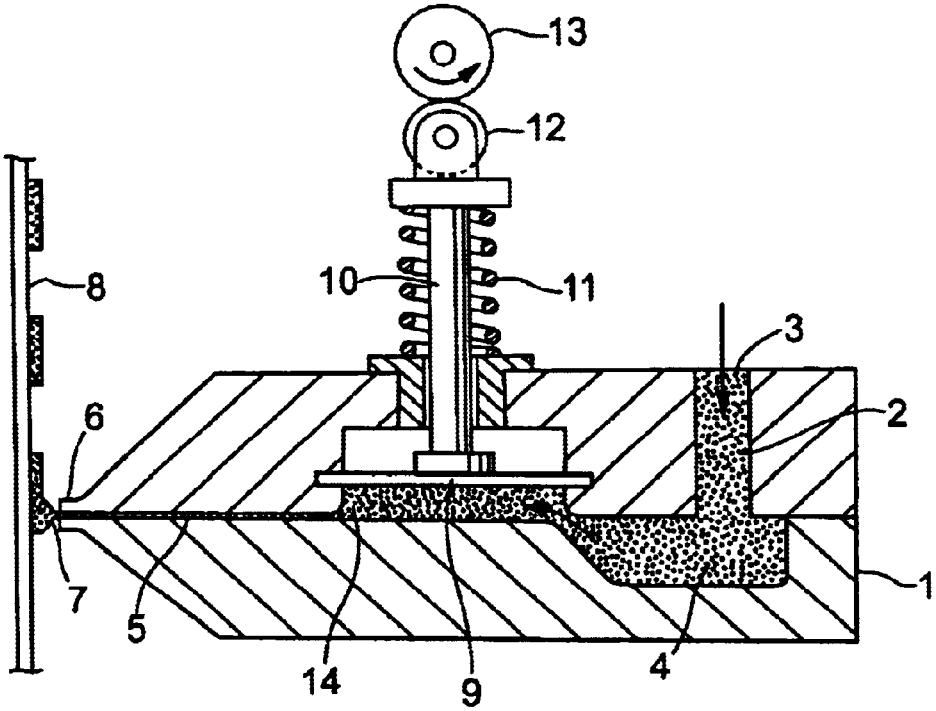
FIG. 4 is a schematic, partly sectional view of a conventional intermittent coating apparatus.

A diaphragm 28, i.e., a flexible sheet is placed in a draw-in chamber 38 formed in a part of the supply passage 24. As shown in FIG. 2, the lower end of a ball screw 29 is attached to the diaphragm 28 and is set upright. A ball nut 33 in engagement with the ball screw 29 is linked to a threaded nut 33 connected to the output shaft 40 of a servomotor 30 by a coupling 31 and supported for rotation by a bearing 32 fixed in the coating die 20. The ball nut 33 is restrained from axial movement. The ball screw 29 and the ball nut 33 are constituents of a ball screw mechanism.

The output shaft of the servomotor 30 is controlled by about 16,000 driving pulses at a full turn. Suppose that the lead of the thread of the ball screw 29 is 0.5 mm, then the stroke of the ball screw 29 can be controlled in steps of 0.03 $\mu$m (=0.5/16,000 mm).

In FIG. 1, reference numeral 35 denotes a controller, 36 denotes a servo driver. The controller 35 controls servomotor 30 on the basis of a control program 34 prepared for a displacement diagram which is corresponding to the predetermined coating pattern. The servo driver 36 includes a closed loop control circuit using a feed back signal provided by a pulse generator 37 that generates a pulse train in which the number of pulses is in proportion to the angular displacement of the output shaft 40 of the servomotor 30. The servo driver 36 controls the servomotor 30, coupled to ball screw 29, so that a difference between the actual position of the ball screw from its desired position is minimized.

Figure 3:
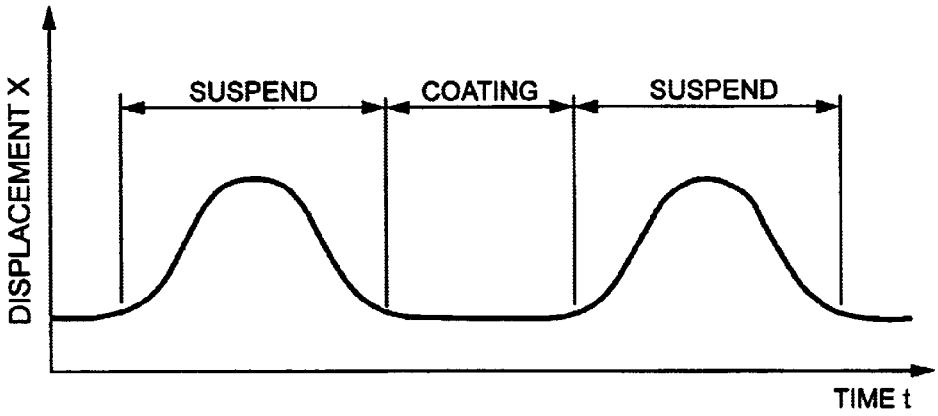
FIG. 3 is an example of a displacement diagram for the ball screw.

FIG. 3 is an example of a displacement diagram, in which the horizontal axis shows a time, the vertical axis shows a displacement of the ball screw 33. The controller 35 calculates a desired value θ of the angular displacement of the servomotor 30 at a given time on the basis of the displacement diagram. The servo driver 36 supplies the desired value θ to the servomotor 30. The servo driver 36 controls the servomotor 30 so as to bring the feed back valve closer to the desired valve θ. Then the change of the phase of the output shaft of the servomotor 30 with time is controlled by a controller 35 so that the deformation of the diaphragm 28 changes with the angular displacement θ of the output shaft of the servomotor 30 as indicated by a displacement diagram shown in FIG. 3.

Normal rotation of the servomotor 30 causes the ball screw 29 to move upward, Reverse rotation of the servomotor 30 causes the ball screw 29 to move downward. The ball nut 33 is thus rotated by the servomotor 30 to move the bull screw 29 reciprocally in by the axial direction. As mentioned above, the ball screw 29 can be moved in steps of 0.03 $\mu$m by rotating the threaded nut 33 by the servomotor 30. Consequently, the diaphragm 28 is deformed according to the reciprocating movement of the ball screw 29 conformable to tho displacement diagram 34, and the volume of the draw-in chamber 38 is changed accordingly to change the flow of the coating material 21 in the supply passage 24. While the diaphragm 28 is being deformed in an upward convex shape by moving the ball screw 29 upward, the volume of the draw-in chamber 38 increases and the discharge of the coating material 21 onto the substrate 27 is suspended. Thus, the coating material 21 is applied intermittently to the substrate 27 in accordance with the coating pattern conformable to the displacement diagram 34. In a case where the coating pattern is to be changed, the control program 34 for the controller 35 is replaced with new one corresponding to the new coating pattern.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. An coating apparatus for applying a coating material to a surface of a substrate being moved continuously, said apparatus comprising:

a coating die having a inlet port through which the coating material is introduced into the coating die, a discharge opening confronting with the substrate, through which the coating material is discharged onto the surface of the substrate, a supply passage defined in the coating die so as to communicate the inlet port with the discharge opening, a manifold chamber for temporarily storing the coating material supplied thereto and which is formed in a part of the supply passage, and a flexible sheet adapted to be displaceable away from the supply passage so that a draw-in chamber for absorbing the coating material is formed in the supply passage;

an intermittent motion generating means having a ball screw mechanism which includes a ball nut and a ball screw for converting rotation of the ball nut into an intermittent reciprocating motion of the ball screw in the axial direction to cause the flexible sheet to be displaced;

a servomotor for driving the ball nut for rotation; and a intermittent motion control means for controlling the servomotor so that the intermittent reciprocating motion to the ball screw causes the draw-in chamber to expand and contract periodically.

2. The coating apparatus according to claim 1, wherein the intermittent motion control means comprises:

a controller for calculating a desired value of a angular displacement of the servomotor on the basis of a control program prepared to correspond to a predetermined intermittent displacement diagram for the ball screw; and a servo control means for providing an output to the servomotor corresponding to the desired value provided by the controller.

3. The coating apparatus according to claim 2, wherein the servo control means comprises a detecting means for detecting a current position of the ball screw and provide an indication thereof so as to form a closed loop control circuit for controlling the ball screw so that a difference between the current position of the ball screw and its desired position is minimized.

4. The coating apparatus according to claim 2, wherein the controller is constructed and arranged so as to receive and execute any of a plurality of control programs corresponding to various coating patterns.

5. The coating apparatus according to claim 1, wherein:

the ball screw has an end portion attached fixedly to the central portion of the flexible sheet;

the ball nut is in engagement with the ball screw and is driven for rotation intermittently by the servomotor; and a bearing for supporting the ball nut rotatably and restrainably from the axial movement.

6. The coating apparatus according to any one of claim 1, 2, 3, 5 or 4, wherein the flexible sheet is a diaphragm.

* * * * *